US007495627B2

(12) United States Patent
Parsche

(10) Patent No.: US 7,495,627 B2
(45) Date of Patent: Feb. 24, 2009

(54) BROADBAND PLANAR DIPOLE ANTENNA STRUCTURE AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 125 days.

(21) Appl. No.: 11/762,954

(22) Filed: Jun. 14, 2007

(65) Prior Publication Data

US 2008/0309572 A1 Dec. 18, 2008

(51) Int. Cl.
*H01Q 21/20* (2006.01)
*H01Q 1/38* (2006.01)

(52) U.S. Cl. ..... 343/800; 343/700 MS

(58) Field of Classification Search ..... 343/700 MS, 343/793, 795, 800, 810, 812
See application file for complete search history.

(56) References Cited

U.S. PATENT DOCUMENTS

| | | | | |
|---|---|---|---|---|
| 4,089,003 | A * | 5/1978 | Conroy | 343/700 MS |
| 4,947,178 | A * | 8/1990 | Shafai | 343/700 MS |
| 5,003,318 | A | 3/1991 | Berneking et al. | 343/700 |
| 5,861,848 | A * | 1/1999 | Iwasaki | 343/700 MS |
| 6,501,427 | B1 | 12/2002 | Lilly et al. | 343/700 |
| 7,109,926 | B2 | 9/2006 | Du Toit | 343/700 |
| 7,126,538 | B2 | 10/2006 | Sampo | 343/700 |
| 2006/0250315 | A1 * | 11/2006 | Parsche | 343/773 |

FOREIGN PATENT DOCUMENTS

| | | |
|---|---|---|
| EP | 1 795 926 | 6/2007 |

OTHER PUBLICATIONS

Wheeler, "The Wide-Bank Matching Area for a Small Antenna", IEEE Transactions on Antennas and Propagation, vol. AP-31, No. 2, Mar. 1984, pp. 364-367.

* cited by examiner

*Primary Examiner*—Hoang V Nguyen
(74) *Attorney, Agent, or Firm*—Allen, Dyer, Doppelt, Milbrath & Gilchrist, P.A.

(57) ABSTRACT

An antenna structure includes an omnidirectional broadband planar dipole antenna including a first electrically conductive disc defining a first dipole antenna element, and a second electrically conductive disc defining a second dipole antenna element in parallel with and spaced apart from the first dipole antenna element. A dual-line antenna feed structure may be connected to the planar dipole antenna and includes a first conductor electrically connected to the first conductive disc adjacent a peripheral edge thereof, and a second conductor electrically connected to the second conductive disc adjacent a peripheral edge thereof. The planar antenna may provide vertical polarization transmission and reception, and it may not require a ground plane. The antenna may use printed circuit construction like microstrip patch antennas. Operation may provide a single band antenna of broad bandwidth, a multiple band antenna, or any combination thereof. Responses may include single, multiple, or the Chebyshev polynomial tuning.

21 Claims, 8 Drawing Sheets

BROADBAND PLANAR DIPOLE ANTENNA STRUCTURE AND ASSOCIATED METHODS

FIELD OF THE INVENTION

The present invention relates to the field of antennas, and more particularly, this invention relates to omnidirectional radiation, planar broadband antennas, microstrip patch antennas, horizontal antennas and vertical polarization, multiple tuning, and related methods.

BACKGROUND OF THE INVENTION

Modern communications systems are increasing in bandwidth requirements, causing greater needs for broadband antennas. Nature, in the present physics may impose fundamental limitations on instantaneous gain bandwidth relative to antenna size and shape. The thin ½ wave wire dipole antenna can have 3 dB gain bandwidth of 13 percent and 2.0 to 1 VSWR bandwidth of only 4.5 percent. This is often not adequate. Broadband dipoles are an alternative to the wire dipole. These preferably utilize cone radiating elements which are better fitted to wave expansion, rather than thin wires. A biconical dipole having, for example, a conical flare angle of $\frac{1}{2}\pi$ radians has essentially a high pass filter response, from a lower cut off frequency. Such an antenna provides higher bandwidth, and a response of 10 or more octaves may be achieved.

In current, everyday communications devices, many different types of conical antennas, such as biconical dipoles, conical monopoles and discone antennas are used in a variety of different ways. These antennas, however, are sometimes expensive or difficult to manufacture and flat planar antennas may be preferable. Antenna shapes may be classified as linear, planar or 3 dimensional.

Many applications, such as land mobile, may require thin planar antennas with vertical polarization when mounted in a horizontal plane. Such antennas can be planar monopoles, sometimes known as microstrip "patch" antennas. The advantages of these antennas including printed circuit manufacture, being mountable in low profile, and having high gain and efficiency have made them the antennas of choice in many applications. However, microstrip patch antennas typically are efficient only in a narrow frequency band. They are poorly shaped for wave expansion, such that microstrip antenna bandwidth is proportional to antenna thickness. Bandwidth can even approach zero with vanishing thickness (for example, see Munson, page 7-8 "Antenna Engineering Handbook", 2nd ed., H. Jasik ed.).

Simple antennas can provide quadratic "single dip" frequency responses, akin to resonant circuits. For instance, a center fed ½ wave wire dipole has an impedance response similar to a series resonant circuit plus a resistor. Multiple tuning has been described as a way to increase instantaneous gain bandwidth from small, simple antennas. In multiple tuning, an antenna may exhibit a rippled frequency response of many "dips" and "peaks", corresponding to staggered resonances in frequency. Wheeler has shown that multiple tuned antennas can provide up to $3\pi$ the bandwidth of single tuned antennas: H. Wheeler, "The Wide-Band Matching Area for a Small Antenna", IEEE Trans. Antennas and Propagation, Vol. AP-31, No. 2 March 1983.

External impedance compensation networks, e.g. of the inductor capacitor (LC ladder) type, may be used to increase bandwidth by multiple tuning single tuned narrowband antennas. The LC network may connect at the antenna driving points between the antenna and the feedline, and the antenna becomes the final resonant section and a load, to a cascade of resonant filter sections. It may be preferable however to obtain the multiple tuned broadband responses directly from the antenna structure, without external compensation networks, for ease of manufacture, power handling and efficiency.

Filter theory may be applied to antenna responses, and multiple tuned frequency responses tailored to polynomials. For example, a Butterworth polynomial may be used for minimal ripple or a Chebyshev polynomial for maximum bandwidth to a controlled ripple.

The bent stacked slot antenna (BSSA) achieves a relatively wide bandwidth and small size and makes use of a center strip of a middle patch as an integrated impedance matching unit. An example of such an antenna is described in the European published patent application EP 795926. However, a disadvantage with the BSSA type of antenna is the relatively narrow bandwidth.

U.S. Pat. No. 5,003,318, to Berneking et al. entitled "Dual Frequency Microstrip Patch Antenna With Capacitively Coupled Feed Pins" describes a planar ground plane antenna with two coaxial feeds or ports. Two separate antennas are collocated in space, each single tuned.

U.S. Pat. No. 6,501,427 to Lilly et al. entitled "Tunable Patch Antenna" is directed to a patch antenna including a segmented patch and reed like MEMS switches on a substrate. Segments of the structure can be switched to reconfigure the antenna, providing a broad tunable bandwidth. Instantaneous bandwidth may be unaffected however.

U.S. Pat. No. 7,126,538 to Sampo entitled "Microstrip antenna" is directed to a microstrip antenna with a dielectric member disposed on a grounded conductive plate. A patch antenna element is disposed on the dielectric member.

U.S. Pat. No. 7,109,926 to du Toit entitled "Stacked patch antenna" discloses a stacked antenna, including a lower patch which may include a coplanar microstrip capable of feeding the stacked antenna and an upper patch which may include a slot-like part thereon and coupled to the upper patch. This antenna also requires a ground plane.

There is a need for a relatively thin or horizontally planar antenna that has a wider instantaneous bandwidth, is more omnidirectional, is for vertical polarization transmission and reception and/or does not require a ground plane.

SUMMARY OF THE INVENTION

In view of the foregoing background, it is therefore an object of the present invention to provide a planar antenna that has a wider bandwidth, is more omnidirectional, is for vertical polarization transmission and reception when horizontally disposed and/or does not require a ground plane.

This and other objects, features, and advantages in accordance with an example of an embodiment of the present invention are provided by an antenna structure including a planar dipole antenna comprising a first conductive disc defining a first dipole antenna element, and a second conductive disc defining a second dipole antenna element in parallel with and spaced apart from the first dipole antenna element. A dual-line antenna feed structure may be connected to the planar dipole antenna and includes a first conductor electrically connected to the first conductive disc adjacent a peripheral edge thereof, and a second conductor electrically connected to the second conductive disc adjacent a peripheral edge thereof. The antenna structure advantageously provides omnidirectional broadband operation. The antenna may also have vertical symmetry, provide balanced dipole operation, and may eliminate the need for a ground plane.

A conductive rod may be connected to and extend between the first and second conductive discs along central axes thereof. The first and second conductive discs may have substantially the same diameter. Also, the first dipole antenna element may also include a third conductive disc in parallel with the first conductive disc, and adjacent to and having a smaller diameter than the first conductive disc. And, the second dipole antenna element may include a fourth conductive disc in parallel with the second conductive disc, and adjacent to and having a smaller diameter than the second conductive disc. The first dipole antenna element may further include a fifth conductive disc in parallel with the third conductive disc, and adjacent to and having a smaller diameter than the third conductive disc. The second dipole antenna element may further include a sixth conductive disc in parallel with the fourth conductive disc, and adjacent to and having a smaller diameter than the fourth conductive disc.

A dielectric block may contain the dual-line antenna feed structure and the planar dipole antenna. The dielectric block preferably includes a plurality of dielectric layers, and each of the first and second conductive discs may comprise a plated conductive layer on a respective dielectric layer. Also, each of the first and second conductors of the dual-line antenna feed structure may comprise a plated conductive via through at least one dielectric layer.

Another aspect is directed to a method of making the antenna structure. The method may include providing a planar dipole antenna comprising a first conductive disc defining a first dipole antenna element, and a second conductive disc defining a second dipole antenna element in parallel with and spaced apart from the first dipole antenna element. The method may also include connecting a dual-line antenna feed structure to the planar dipole antenna and comprising electrically connecting a first conductor to the first conductive disc adjacent a peripheral edge thereof, and electrically connecting a second conductor to the second conductive disc adjacent a peripheral edge thereof.

The first and second conductive discs may have substantially the same diameter. Providing the planar dipole antenna may include providing the first dipole antenna element with a third conductive disc in parallel with the first conductive disc, and adjacent to and having a smaller diameter than the first conductive disc. The second dipole antenna element may be provided with a fourth conductive disc in parallel with the second conductive disc, and adjacent to and having a smaller diameter than the second conductive disc. Providing the planar dipole antenna may further include providing the first dipole antenna element with a fifth conductive disc in parallel with the third conductive disc, and adjacent to and having a smaller diameter than the third conductive disc, and providing the second dipole antenna element with a sixth conductive disc in parallel with the fourth conductive disc, and adjacent to and having a smaller diameter than the fourth conductive disc.

The method may also include providing a dielectric block containing the dual-line antenna feed structure and the planar dipole antenna. Furthermore, providing the dielectric block may include providing a plurality of dielectric layers. Providing the planar dipole antenna may comprise forming each of the first and second conductive discs as a plated conductive layer on a respective dielectric layer. Connecting the dual line antenna feed structure may comprise forming each of the first and second conductors as a plated conductive via through at least one dielectric layer.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
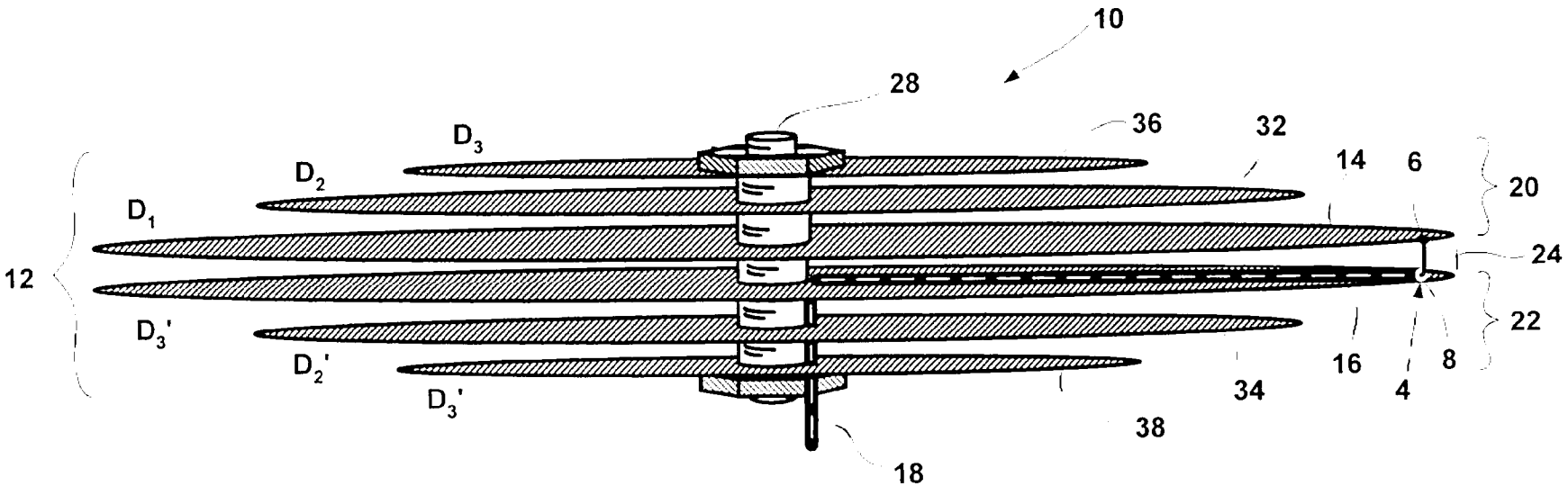
FIG. 1 is a side perspective view illustrating an embodiment of an antenna structure including a planar didole antenna in accordance with the present invention.
Figure 2:
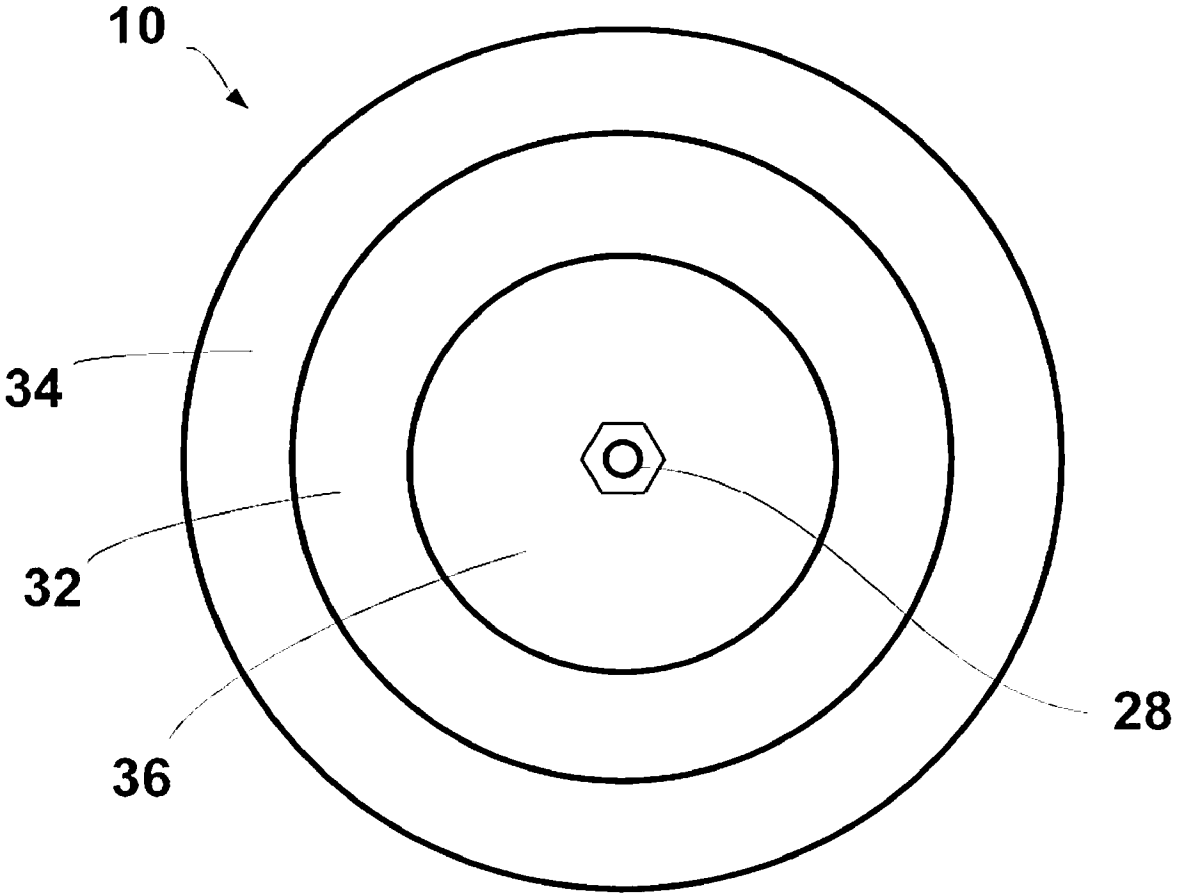
FIG. 2 is top view illustrating the antenna structure of FIG. 1.

Referring initially to FIGS. 1 and 2, a planar dipole antenna structure 10 will be described that has a wider bandwidth, is omnidirectional, is for vertical polarization transmission and reception and/or does not require a ground plane. The broadband planar dipole antenna 12 includes a first conductive disc 14 defining a first dipole antenna element 20 (i.e. one-half of a dipole), and a second conductive disc 16 defining a second dipole antenna element 22 (i.e. the other half of the dipole) in parallel with and spaced apart from the first dipole antenna element 20. The first and second conductive discs 14, 16 may have substantially the same diameter. Also, the discs are generally or substantially circular in the illustrated embodiments, but they also could be generally oval, elliptical or even rectangular with some changes in expected performance.

A dual-line antenna feed structure 18 may be connected to the planar dipole antenna 12 and includes a first conductor 24 electrically connected to the first conductive disc 14 adjacent a peripheral edge thereof, and a second conductor 26 electrically connected to the second conductive disc 16 adjacent a peripheral edge thereof. For example, the dual-line antenna feed structure 18 may be a coaxial cable having an inner conductor and an outer conductor in surrounding relation thereto. The second conductor 26 may also be connected, e.g. soldered, to extend along a radius of the second conductive disc 16. The end point of the coax cable, and the attachment point of the center conductor define two antenna driving points 6, 8, which together form an antenna port 4, as is common.

A conductive rod 28 may be connected to and extend between the first and second conductive discs 14, 16 along central axes thereof. The rod 28 acts as a shunt to cause a low resistance, e.g. about 50 ohm, driving point resistance for the planar dipole antenna 12.

Also, the first dipole antenna element 20 may also include a third conductive disc 32 in parallel with the first conductive disc 14, and adjacent to and having a smaller diameter than the first conductive disc. And, the second dipole antenna element 22 may include a fourth conductive disc 34 in parallel with the second conductive disc 16, and adjacent to and having a smaller diameter than the second conductive disc. The first dipole antenna element 20 may further include a fifth conductive disc 36 in parallel with the third conductive disc 32, and adjacent to and having a smaller diameter than the third conductive disc. The second dipole antenna element 22 may further include a sixth conductive disc 38 in parallel with the fourth conductive disc 34, and adjacent to and having a smaller diameter than the fourth conductive disc.

Figure 3:
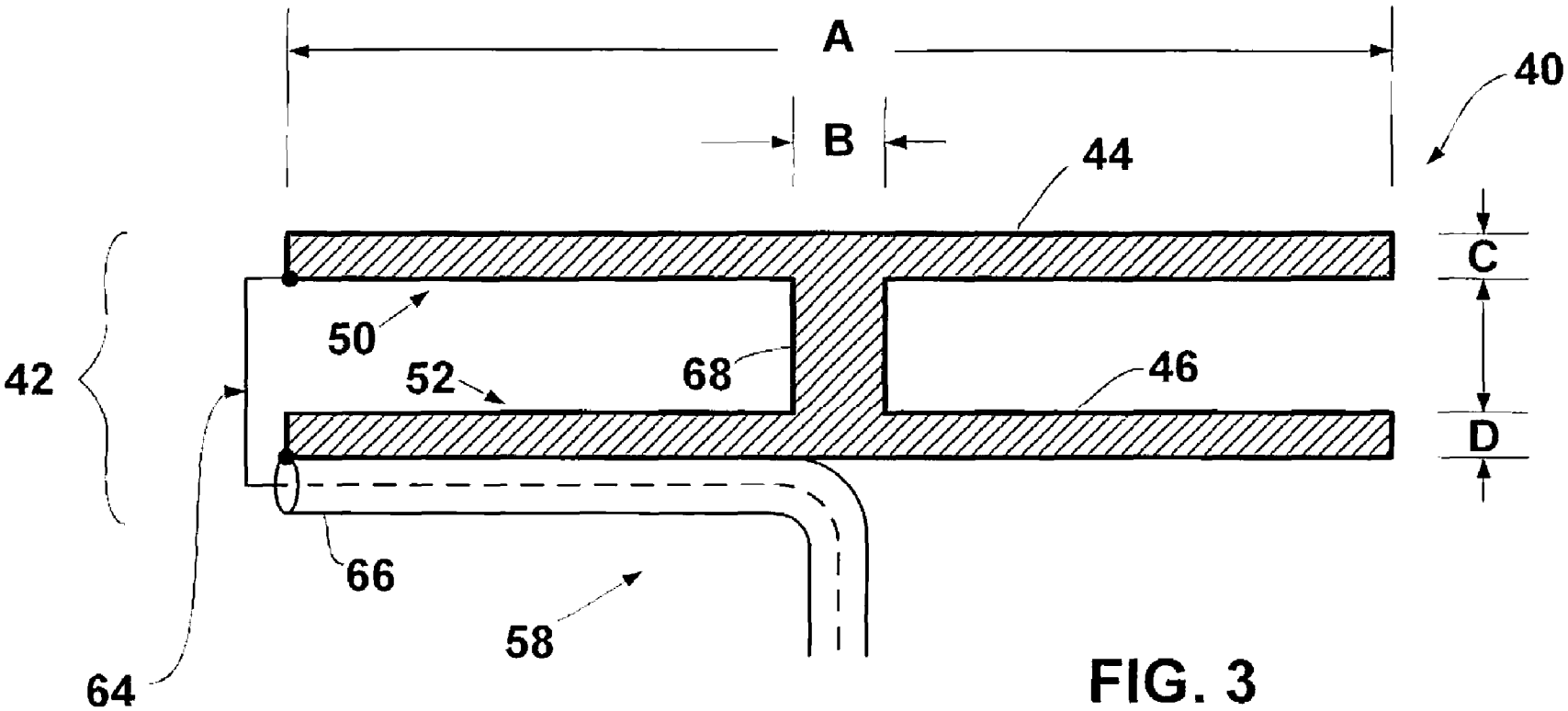
FIG. 3 is a schematic cross-sectional side view illustrating another embodiment of an antenna structure including a planar dipole antenna in accordance with the present invention.

Now referring to FIG. 3, another example of a planar dipole antenna structure 40 that is broadband, omnidirectional and vertically polarized will be described. The broadband planar dipole antenna 42 includes a first conductive disc 44 defining a first dipole antenna element 50, and a second conductive disc 46 defining a second dipole antenna element 52 in parallel with and spaced apart from the first dipole antenna element 50. The first and second conductive discs 44, 46 may have substantially the same diameter.

A dual-line antenna feed structure 58 may be connected to the planar dipole antenna 42 and includes a first conductor 64 electrically connected to the first conductive disc 44 adjacent a peripheral edge thereof, and a second conductor 66 electrically connected to the second conductive disc 46 adjacent a peripheral edge thereof. For example, again, the dual-line antenna feed structure 58 may be a coaxial cable having an inner conductor and an outer conductor in surrounding relation thereto. The second conductor 66 may also be connected, e.g. soldered, to extend along a radius of the second conductive disc 66.

A conductive rod 68 may be connected to and extend between the first and second conductive discs 44, 46 along central axes thereof. The rod 68 acts to cause a low driving point resistance, e.g. about 50 ohms, shunt feed for the planar dipole antenna 42.

One method of construction for the planar dipole antenna structure 10 can be to thread center rod 28, and to screw threaded center rod 28 into threaded holes in conductive discs 14, 32, 36, 16, 34, 38. By threading center rod 28, nuts and spacer washers or jamb nut techniques may also be used, as are common. The invention is not however limited as to only threaded or nut and bolt construction, and welding or even metal plated plastic construction are feasible.

A theory of operation for a 2 disc version of the present invention will now be described. Broadband planar dipole antenna 12 radiates by separation of charge between conductive discs 14, 16. The distal, outer surfaces of conductive discs 14, 16 function as the dipole half elements. The rims of conductive discs 14, 16 may also be considered as slot dipole half elements from which diffractive type radiation occurs due to separation of charge. In general there is no circular motion of charge or loop radiation as the discs convey radial currents only, and separation of charge is greatest between the conductive disc rims. When the overall height of dipole antenna structure 10 is thin, fundamental or first resonance occurs for disc diameters of about ¼ wavelength.

Continuing the 2 disc theory of operation, the proximal, interior faces of conductive discs 14, 16 function as transmission line conductors to each other, that are radial, balanced, and microstrip. Conductive rod 28 acts as a short circuit between the conductive discs 14, 16, and impedance matching transmission line stub is formed in place by the combination of conductive rod 28 (the short) and conductive discs 14, 26 (the transmission line conductors). This in situ transmission line refers the antenna driving point resistance to a lower value, i.e. a shunt feeding approach. In general, closer spacing between conductive rod 29 and the driving points 6, 8 provide a lower driving resistances and wider spacings provide higher resistances. Resistance is preferably adjusted to provide 50 ohms in common practice, for coaxial cable.

Although the driving points 6, 8 are not at the geometric center of planar dipole antenna structure 10, the realized azimuth (H field plane) radiation patterns are circular or nearly so. Conductive rod 28 need not be located at the geometric center of conductive discs 14, 16, and it may be in fact be located at the disc rims, and the driving points 6,8 located to the disc center or elsewhere. A method is in fact provided in which the driving points 6,8 and conductive rod 28 may be located as desired for impedance matching. In general, the closer the discs are together, the further apart driving points 6,8 will need be from the shorting post/conductive rod 28 to obtain 50 ohms resistance at resonance.

A non-limiting example of the planar 2 disc dipole antenna 42 is outlined by the following table:

Two Disc Example Of The Invention

| Parameter | Specification |
|---|---|
| Antenna Type | Planar Dipole/Slot Dipole |
| Overall Thickness Of Antenna | 0.049λ |
| Dimension A: Brass Disc Diameter | 0.32λ each |
| Dimension B: Brass Center Post Diameter | 0.038λ |
| Dimension D: Brass Disc Spacing, Between Proximal Faces | 0.042λ |
| Dimensions C, E: Disc Thickness | 0.0038λ each |
| Aspect Ratio (Diameter To Height) | 6.5 to 1 |
| Feedpoint Location | Driven Between Rims Of Discs |
| Feed Point Impedance | 50 Ω |
| VSWR | 1.2 to 1 |
| 2 to 1 VSWR Bandwidth | 7.0 Percent |
| 3 dB Gain Bandwidth | 21.9 Percent |
| Azimuth Radiation Pattern | Circular/ Omnidirectional |
| Elevation Radiation Pattern | $\sin^2\theta$ Two Petal Rose (Like ½ Wave Dipole) Lobes In Disc Planes, Nulls Normal To Discs |
| Gain | +2 dBi with balun |
| Response Shape | Approximately Quadratic |

As can be appreciated by those in the art, the 2 to 1 VSWR bandwidth of the two disc example of the present invention exceeds that of a thin diameter wire half wave dipole by about 55 percent and in about 1/10 the height. In addition, an exact 50 ohm driving point resistance is obtainable.

Referring to FIG. 1, a non-limiting example of a 4 disc embodiment of planar dipole antenna 42 is outlined in the following table.

Four Disc Example Of The Invention

| Parameter | Specification |
|---|---|
| Antenna Type | Planar Dipole/Slot Dipole |
| Overall Thickness Of Antenna | 0.105λ |
| Brass Disc Diameter, Discs $D_2$ and $D_2$ and $D_2'$ | 0.200λ |
| Brass Disc Diameter, Discs $D_1$ and $D_1'$ | 0.265λ |
| Brass Disc Diameter, Inner Discs $D_3$ and $D_3'$ | $D_3$ and $D_3'$ Not Used |
| Dimension B: Brass Center Post Diameter | 0.010λ |
| Dimension D: Disc Spacing, $D_1$ to $D_2$ and $D_1'$ to $D_2'$ Distance Between Proximal Faces | 0.138λ |
| Dimension D: Disc Spacing, $D_1$ to $D_1'$ | 0.067λ |
| Dimensions C, E: Disc Thickness | 0.0038λ each |
| Aspect Ratio (Diameter To Height) | 2.7 to 1 |
| Feedpoint Location | Driven Between Rims Of Discs $D_1$ and $D_1'$ |
| Feed Point Impedance | 50 Ω |
| Ripple Amplitude | VSWR Set to 4 to 1 At Ripple Peak |
| 3 dB Gain Bandwidth (Approximately = 6 to 1 VSWR Bandwidth) | 37.3 Percent |
| Azimuth Radiation Pattern | Circular/ Omnidirectional |
| Elevation Radiation Pattern | ½ Wave Dipole Like: 2 petal rose ($\sin^2\theta$). Lobes In Disc Planes, Nulls Normal To Discs |
| Gain | +2 dBi (When Balun Is Configured) |
| Frequency Response Type | Similar To $4^{th}$ Order Chebyshev |

A theory of operation for a 4 or more disc planar dipole antenna structure 10 will now be described. Radiation, as in 2 disc versions, is by separation of charge/dipole moment. The interior surfaces of conductive discs 14, 32, 36, 16, 34, 38 function as transmission lines and the exterior surfaces as dipole radiating elements, as the spaces between discs are evanescent to waves. The diameter of the conductive discs 14, 32, 36, 16, 34, 38 set the frequencies of the response poles (VSWR dips, gain peaks) and the spacing between the conductive discs 14, 32, 36, 16, 34, 38 sets the depth of the passband ripple. When antenna structure 10 is thin overall, discs are about ¼ wavelength in diameter at their respective operating frequencies.

Figure 4:
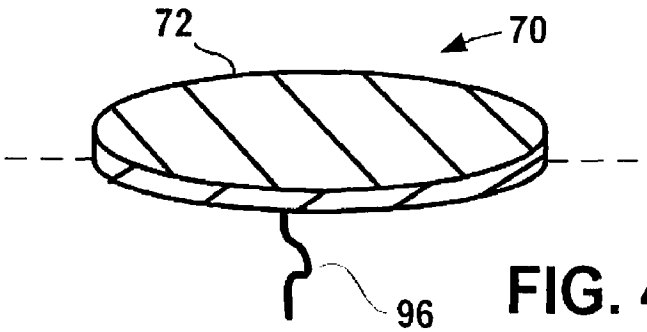
FIG. 4 is a perspective view illustrating a printed circuit embodiment of an antenna structure including a planar dipole antenna in accordance with the present invention.

Now referring to FIGS. 4 and 5, an example of a multilayer printed circuit embodiment of a planar dipole antenna structure 70 that is broadband, omnidirectional and vertically polarized will be described. The antenna structure 70 includes a dielectric block 80 having a plurality of dielectric layers 82, and a planar dipole antenna 72. A first conductive disc 74 is plated on a first dielectric layer of the plurality of dielectric layers 82 and defines a first dipole antenna element 92. A second conductive disc 76 is plated on a second dielectric layer of the plurality of dielectric layers 82 and defines a second dipole antenna element 94 in parallel with and spaced apart from the first dipole antenna element 92. The first and second conductive discs 74, 76 may have substantially the same diameter.

A dual-line antenna feed structure 96 may be connected to the planar dipole antenna 72 and includes a first conductive via 97 through the dielectric layers 82 and electrically connected to the first conductive disc 74 adjacent a peripheral edge thereof, and a second conductive via 98 through the dielectric layers 82 and electrically connected to the second conductive disc 76 adjacent a peripheral edge thereof.

The first dipole antenna element 92 may also include a third conductive disc 100 plated on a third dielectric layer of the plurality of dielectric layers 82 and in parallel with the first conductive disc 74, and adjacent to and having a smaller diameter than the first conductive disc. The second dipole antenna element 94 may include a fourth conductive disc 102 plated on a fourth dielectric layer of the plurality of dielectric layers 82 and in parallel with the second conductive disc 76, and adjacent to and having a smaller diameter than the second conductive disc.

The first dipole antenna element 92 may further include a fifth conductive disc 104 plated on a fifth dielectric layer of the plurality of dielectric layers 82 and in parallel with the third conductive disc 100, and adjacent to and having a smaller diameter than the third conductive disc. The second dipole antenna element 94 may further include a sixth conductive disc 106 plated on a sixth dielectric layer of the plurality of dielectric layers 82 and in parallel with the fourth conductive disc 102, and adjacent to and having a smaller diameter than the fourth conductive disc.

Figure 5:
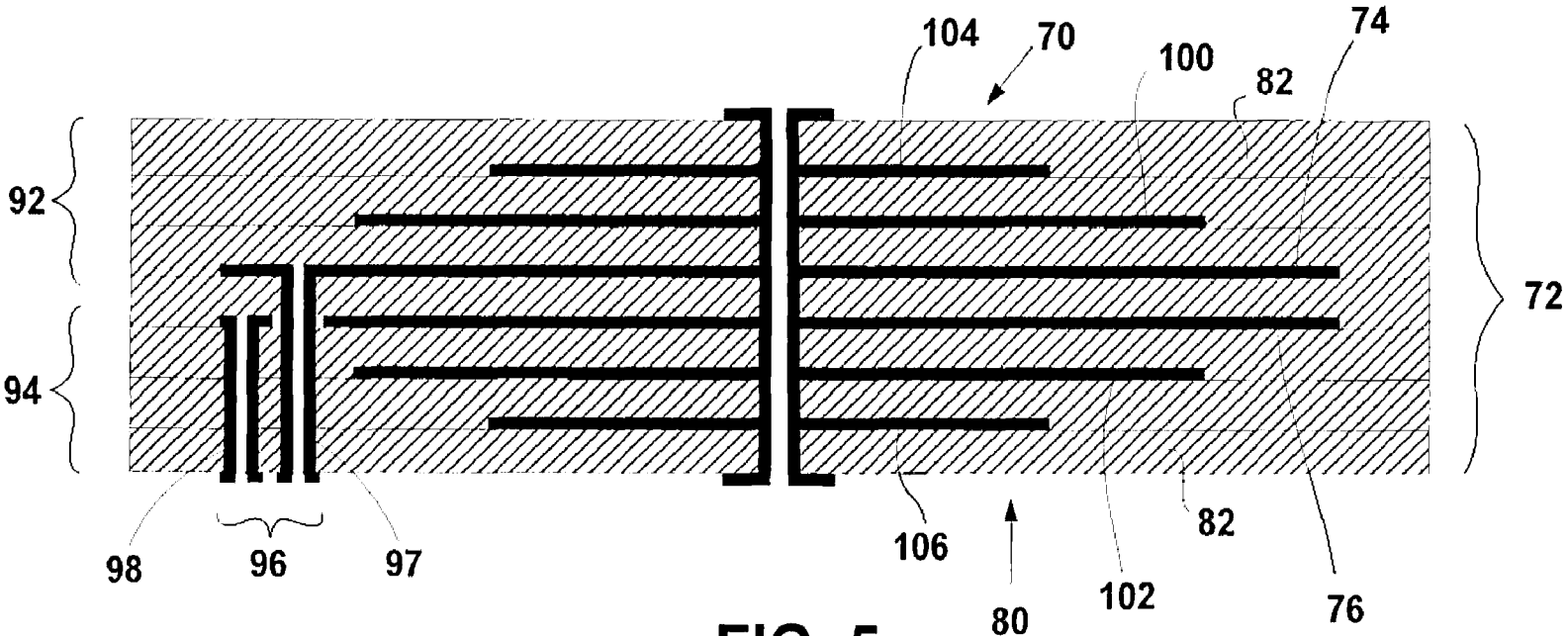
FIG. 5 is a cross-sectional side view illustrating the printed circuit antenna structure of FIG. 4.

The FIG. 5 printed circuit embodiment of the present invention provides broad bandwidth by staggering the diameters and resonances of the conductive discs 76, 74, 82, 100, 106, 104. Dielectric layers 82 provide dielectric loading to the printed circuit embodiment and a reduction in size. Dielectric layers 82 may include dielectric materials only, magnetic materials only, or they may include magnetodielectic materials having both magnetic and dielectric properties.

Figure 6:
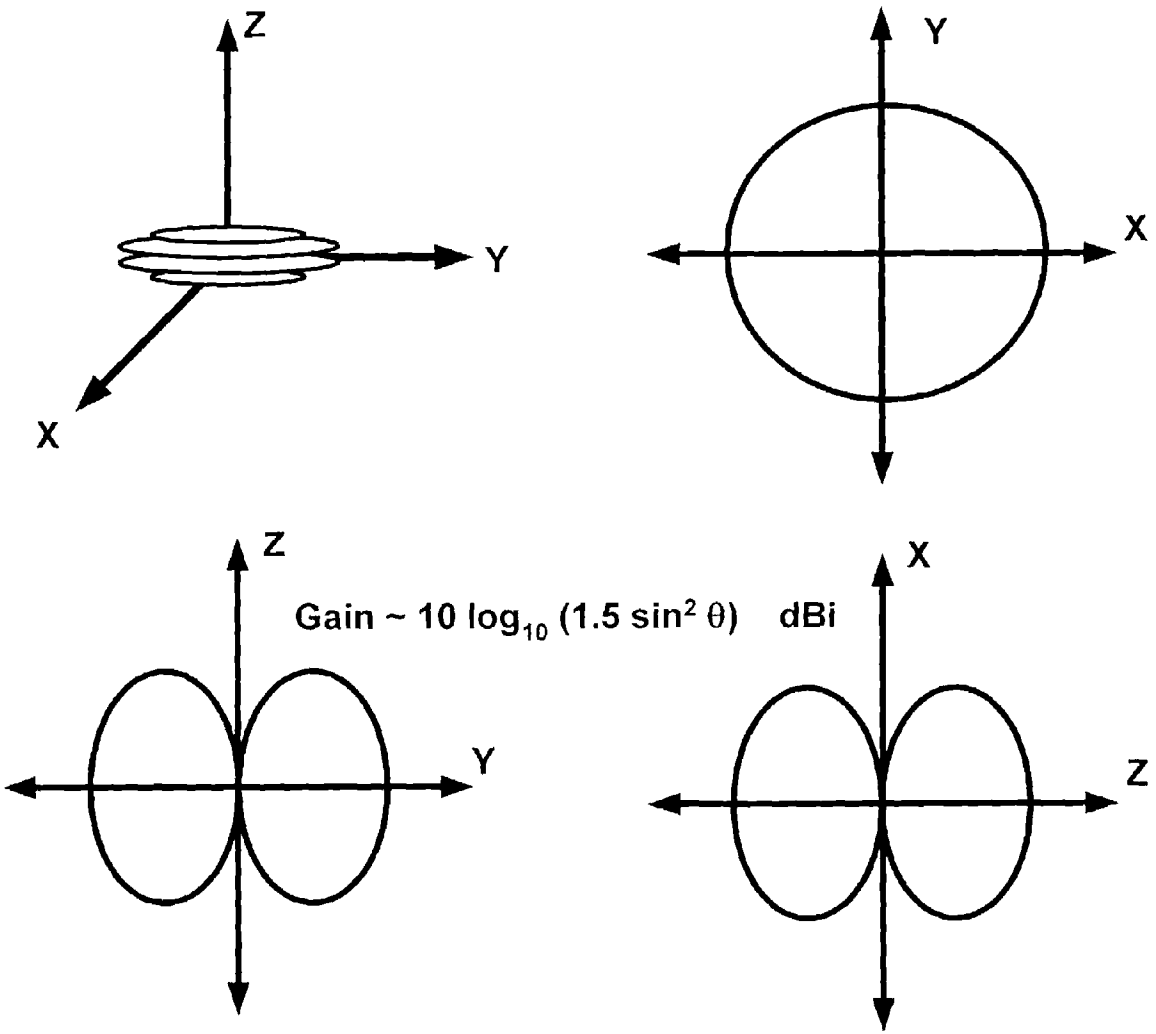
FIG. 6 is a series of graphs illustrating theoretical radiation patterns relating to the planar dipole antenna of FIG. 1.
Figure 7:
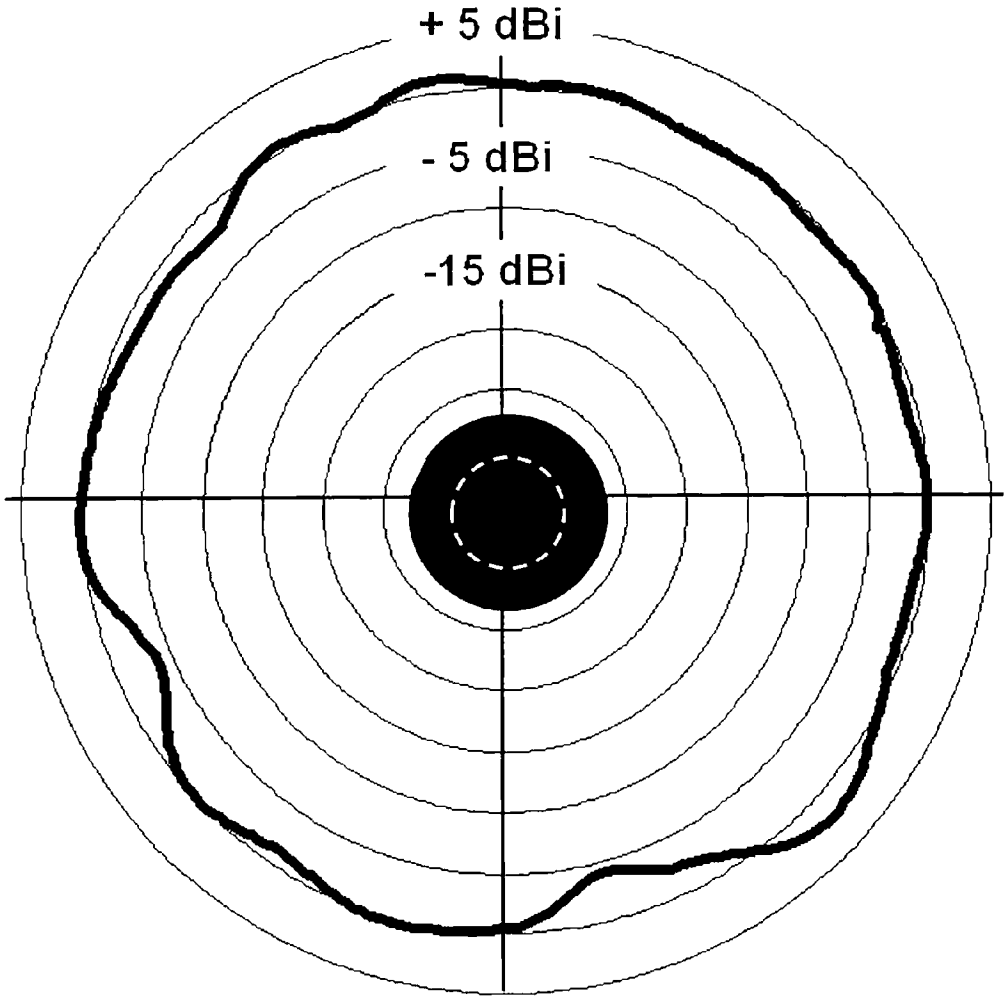
FIG. 7 is a graph illustrating a measured XY azimuth plane radiation pattern of the planar dipole antenna of FIG. 1.
Figure 8:
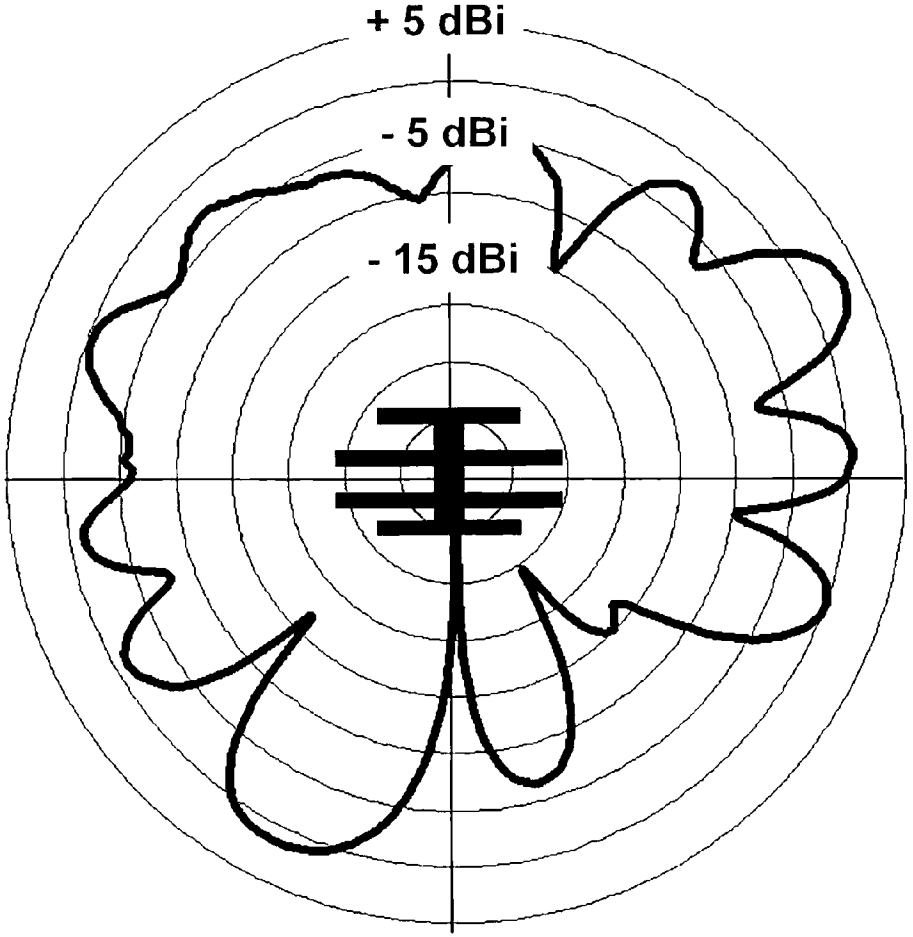
FIG. 8 is a graph illustrating a measured YZ elevation plane radiation pattern of the planar dipole antenna of FIG. 1.

Radiation patterns of the present invention will now be considered. FIG. 6 is a series of graphs illustrating theoretical radiation patterns relating to the planar dipole antenna of FIG. 1, based on electrically small antenna theory. The patterns are those of the elemental dipole, which can be similar to realized radiation patterns of present invention. FIG. 7 is a graph illustrating a measured XY azimuth plane radiation pattern of a prototype of the planar dipole antenna of FIG. 1. Units are in decibels with respect to isotropic (dBi) and the source antenna was linearly polarized. FIG. 8 is a graph illustrating a measured YZ elevation plane radiation pattern of a prototype of the planar dipole antenna of FIG. 1. Again, units are in decibels with respect to isotropic (dBi) and the source antenna was linearly polarized. The FIG. 8 pattern is an E plane cut and the FIG. 7 pattern an H plane cut. Measured radiation patterns include ripple contribution from coaxial cable common mode currents, as a balun was not used for sake of economy. Cross polarized radiation was generally low.

Figure 9:
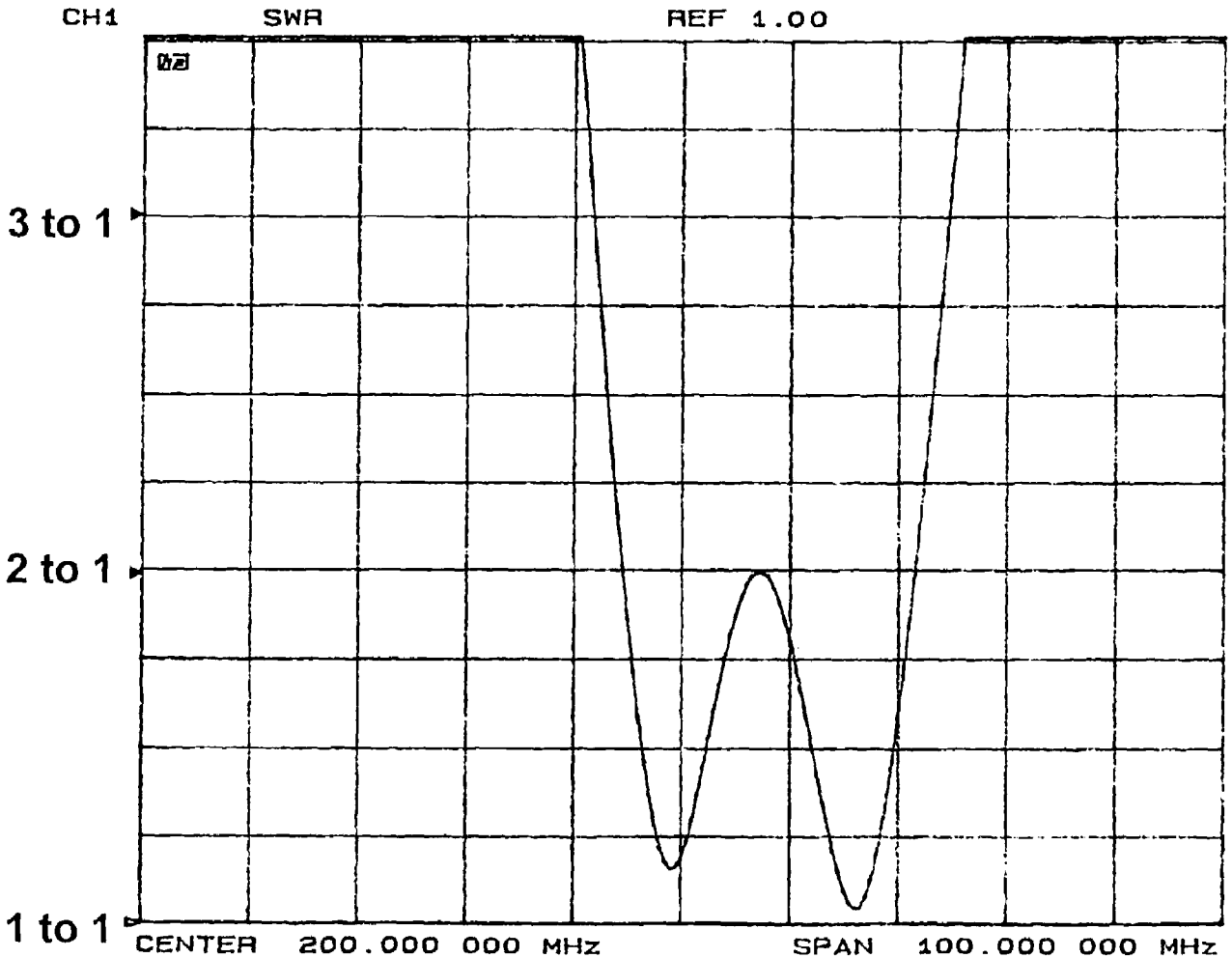
FIG. 9 is a graph of the Voltage Standing Wave Ratio (VSWR) of a four disc embodiment of the present invention.

FIG. 9 is the VSWR response of an especially thin 4 disc embodiment of the present invention, illustrating a double tuned response. This example provided a VSWR ripple level of 2 to 1 and the overall thickness was λ/41.

Biconical dipoles, such as those described in U.S. Pat. No. 3,618,017, to Carter and entitled "Shortwave Antenna" may typically require height dimensions of about ⅓ wavelength. As can be appreciated by those in the art, the present invention operates at dimensions well below the lower cutoff frequency of similar height biconical dipoles. In fact, the present invention may be made arbitrarily thin, with tradeoffs in instantaneous gain bandwidth.

A method of making an antenna structure 10, 40, 70 includes providing a planar dipole antenna 12, 42, 72 comprising a first conductive disc 14, 44, 74 defining a first dipole antenna element 20, 50, 92, and a second conductive disc 16, 46, 76 defining a second dipole antenna element 22, 52, 94 in parallel with and spaced apart from the first dipole antenna element. The method may include connecting a dual-line antenna feed structure 18, 58, 96 to the planar dipole antenna and comprising electrically connecting a first conductor 24, 64, 97 to the first conductive disc adjacent a peripheral edge thereof, and electrically connecting a second conductor 26, 66, 97 to the second conductive disc adjacent a peripheral edge thereof.

Providing the planar dipole antenna 12, 42, 72 may include providing the first dipole antenna element with a third conductive disc 32, 100 in parallel with the first conductive disc, and adjacent to and having a smaller diameter than the first conductive disc. The second dipole antenna element may be provided with a fourth conductive disc 34, 102 in parallel with the second conductive disc, and adjacent to and having a smaller diameter than the second conductive disc. Providing the planar dipole antenna may further include providing the first dipole antenna element with a fifth conductive disc 36, 104 in parallel with the third conductive disc, and adjacent to and having a smaller diameter than the third conductive disc, and providing the second dipole antenna element with a sixth conductive disc 38, 106 in parallel with the fourth conductive disc, and adjacent to and having a smaller diameter than the fourth conductive disc.

The method may also include providing a dielectric block 80 containing the dual-line antenna feed structure 96 and the planar dipole antenna 72. Furthermore, providing the dielectric block 80 may include providing a plurality of dielectric layers 82. Providing the planar dipole antenna may comprise forming each of the conductive discs 74, 76, 100, 102, 104, 106 as a plated conductive layer on a respective dielectric layer 82. Connecting the dual line antenna feed structure may comprise forming each of the first and second conductors 97, 98 as a plated conductive via through at least one dielectric layer 82.

Although this invention is primarily directed towards providing a single continuous frequency band antenna with broad bandwidth and a controlled passband ripple, the present invention also includes a method, wherein conductive discs may be configured to provide a single wideband operating band, a multiplicity of separate operating bands widely spaced, or any combination. For instance the passband gain peaks (which correspond to VSWR ripple valleys) may be specified as individual discrete operating bands. Conductive discs 14, 32, 36 and 16, 34, 38 may be tuned widely apart by adjustment of dimensions, to form widely separated discrete operating bands. The discrete operating bands may be dissonant, harmonically related or both.

As can be appreciated by those in the art, a rippled passband antenna can be a single or multiple band antenna simply by choice of operating specification.

It has been found in practice that the large diameter discs may also be located at the outside, and the smaller ones at the inside with useful results. It is also possible to tie the disc edges together with a hookup wire across the driving points to vary coupling and passband ripple.

The present invention is not so limited as to require symmetry between discs in the upper and lower half spaces, and it can be modified to form an image equivalent or ground plane type antenna for operation on conductive surfaces, such as say a large metal roof. To accomplish this, referring now to FIG.1, conductive discs 16 and 34 and 38 would be omitted, and conductive rod 28 attaches onto the ground plane with the ground plane then replacing the lower half of the antenna structure. As the driving point resistance is halved by the ground plane, it is advisable to adjust the impedance match by raising the height of disc 16 slightly by lengthening conductive rod 28. As can be appreciated by those in the art, the ground plane embodiment of the present invention is merely the omission of discs 34, 38 accompanied by the notable enlargement of disc 16, which forms the "ground plane". It is even possible to form , for example, an "inverted ground plane" antenna, by the enlargement of disc 6 and the omission of discs 32, 36.

In the present invention, asymmetry between upper and lower discs may also be used to tailor the elevation plane radiation patterns, e.g. for concentrating most of the radiation into a single half space.

The number of conductive discs that may be included in embodiments of the present invention is non-limiting, and 8, or even 12 conductive discs may be included. Thus, the present invention may include a type of periodic antenna.

A multiple tuned planar dipole has been described then, providing increased bandwidth over prior art single tuned dipoles. The Chebyshev polynomial type frequency response can provide 4 to 3π more bandwidth than prior art quadratic response antennas, by the incorporation of multiple discs and specification of passband ripple. Accordingly, the present invention provides a vertically polarized horizontally planar omnidirectional antenna of broad instantaneous gain bandwidth and thin dimension. The present invention may operate as a multiple band antenna, and operate with or without a ground plane.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna structure comprising:
- a planar dipole antenna comprising
  - a first electrically conductive disc defining a first dipole antenna element, and
  - a second electrically conductive disc defining a second dipole antenna element in parallel with and spaced apart from the first dipole antenna element; and
- a dual-line antenna feed structure connected to the planar dipole antenna and comprising
  - a first conductor electrically connected to the first conductive disc adjacent a peripheral edge thereof, and
  - a second conductor electrically connected to the second conductive disc adjacent a peripheral edge thereof.

2. The antenna structure according to claim 1, wherein the planar dipole antenna further comprises an electrically conductive rod connected to and extending between the first and second conductive discs along central axes thereof.

3. The antenna structure according to claim 1, wherein the first and second conductive discs have substantially the same diameter.

4. The antenna structure according to claim 1, wherein the first dipole antenna element further comprises a third conductive disc in parallel with the first conductive disc, and adjacent to and having a smaller diameter than the first conductive disc; and wherein the second dipole antenna element further comprises a fourth conductive disc in parallel with the second conductive disc, and adjacent to and having a smaller diameter than the second conductive disc.

5. The antenna structure according to claim 4, wherein the first dipole antenna element further comprises a fifth conductive disc in parallel with the third conductive disc, and adjacent to and having a smaller diameter than the third conductive disc; and wherein the second dipole antenna element further comprises a sixth conductive disc in parallel with the fourth conductive disc, and adjacent to and having a smaller diameter than the fourth conductive disc.

6. The antenna structure according to claim 1, further comprising a dielectric block containing the dual-line antenna feed structure and the planar dipole antenna.

7. The antenna structure according to claim 6, wherein the dielectric block comprises a plurality of dielectric layers, and each of the first and second conductive discs comprises a plated conductive layer on a respective dieletric layer.

8. The antenna structure according to claim 7, wherein each of the first and second conductors of the dual-line antenna feed structure comprises a plated conductive via through at least one dielectric layer.

9. An antenna structure comprising:

a dielectric block comprising a plurality of dielectric layers;

a planar dipole antenna comprising a first electrically conductive disc plated on a first dieletric layer of the plurality of dielectric layers and defining a first dipole antenna element, and a second electrically conductive disc plated on a second dielectric layer of the plurality of dielectric layers and defining a second dipole antenna element in parallel with and spaced apart from the first dipole antenna element; and a dual-line antenna feed structure connected to the planar dipole antenna and comprising a first conductive via through the first dieletric layer and electrically connected to the first conductive disc adjacent a peripheral edge thereof, and a second conductive via through the first and second dielectric layers and electrically connected to the second conductive disc adjacent a peripheral edge thereof.

10. The antenna structure according to claim 9, wherein the planar dipole antenna further comprises a plated electrically conductive rod connected to and extending between the first and second conductive discs along central axes thereof.

11. The antenna structure according to claim 9, wherein the first and second conductive discs have substantially the same diameter.

12. The antenna structure according to claim 9, wherein the first dipole antenna element further comprises a third conductive disc plated on a third dielectric layer of the plurality of dielectric layers and in parallel with the first conductive disc, and adjacent to and having a smaller diameter than the first conductive disc; and wherein the second dipole antenna element further comprises a fourth conductive disc plated on a fourth dielectric layer of the plurality of dielectric layers and in parallel with the second conductive disc, and adjacent to and having a smaller diameter than the second conductive disc.

13. The antenna structure according to claim 12, wherein the first dipole antenna element further comprises a fifth conductive disc plated on a fifth dielectric layer of the plurality of dielectric layers and in parallel with the third conductive disc, and adjacent to and having a smaller diameter than the third conductive disc; and wherein the second dipole antenna element further comprises a sixth conductive disc plated on a sixth dielectric layer of the plurality of dielectric layers and in parallel with the fourth conductive disc, and adjacent to and having a smaller diameter than the fourth conductive disc.

14. A method of making an antenna structure comprising:

providing a planar dipole antenna comprising a first electrically conductive disc defining a first dipole antenna element, and a second electrically conductive disc defining a second dipole antenna element in parallel with and spaced apart from the first dipole antenna element; and connecting a dual-line antenna feed structure to the planar dipole antenna and comprising electrically connecting a first conductor to the first conductive disc adjacent a peripheral edge thereof, and electrically connecting a second conductor to the second conductive disc adjacent a peripheral edge thereof.

15. The method according to claim 14, wherein providing the planar dipole antenna further comprises providing an electrically conductive rod connected to and extending between the first and second conductive discs along central axes thereof.

16. The method according to claim 14, wherein the first and second conductive discs have substantially the same diameter.

17. The method according to claim 16, wherein providing the planar dipole antenna comprises:

providing the first dipole antenna element with a third conductive disc in parallel with the first conductive disc, and adjacent to and having a smaller diameter than the first conductive disc; and providing the second dipole antenna element with a fourth conductive disc in parallel with the second conductive disc, and adjacent to and having a smaller diameter than the second conductive disc.

18. The method according to claim 17, wherein providing the planar dipole antenna further comprises:

providing the first dipole antenna element with a fifth conductive disc in parallel with the third conductive disc, and adjacent to and having a smaller diameter than the third conductive disc; and providing the second dipole antenna element with a sixth conductive disc in parallel with the fourth conductive disc, and adjacent to and having a smaller diameter than the fourth conductive disc.

19. The method according to claim 14, further comprising providing a dielectric block containing the dual-line antenna feed structure and the planar dipole antenna.

20. The method according to claim 19, wherein providing the dielectric block comprises providing a plurality of dielectric layers; and wherein providing the planar dipole antenna comprises forming each of the first and second conductive discs as a plated conductive layer on a respective dieletric layer.

21. The method according to claim 19, wherein connecting the dual line antenna feed structure comprises forming each of the first and second conductors as a plated conductive via through at least one dielectric layer.

* * * * *